US005244153A

United States Patent [19]

Kuhn et al.

[11] Patent Number: 5,244,153

[45] Date of Patent: Sep. 14, 1993

[54] WATER GUN DIRECTIONAL NOZZLE

[76] Inventors: James O. Kuhn, 140 Nassau St., New York, N.Y. 10038; Lee J. Goldman, 23 Buckingham Ave., Harvey Cedar, N.J. 08008

[21] Appl. No.: 901,831

[22] Filed: Jun. 22, 1992

[51] Int. Cl.[5] ..... B05B 15/08

[52] U.S. Cl. ..... 239/587.5; 222/79; 222/401

[58] Field of Search ..... 239/587.1, 587.4–587.6; 222/79, 401; 273/349; 446/473, 483

[56] References Cited

U.S. PATENT DOCUMENTS

| | | | |
|---|---|---|---|
| D. 304,049 | 10/1989 | Lee | D21/147 |
| 2,746,644 | 5/1956 | Steiner | 222/79 |
| 2,888,172 | 5/1959 | O'Brian | 222/79 |
| 3,040,932 | 6/1962 | Barricks | 222/79 |
| 3,146,911 | 9/1964 | Shun | 222/79 |
| 4,492,318 | 1/1985 | Luk | 222/79 |
| 4,597,527 | 7/1986 | Sands | 222/79 |
| 4,615,488 | 10/1986 | Sands | 222/79 |
| 5,074,437 | 12/1991 | D'Andrade et al. | 222/401 |

FOREIGN PATENT DOCUMENTS

| | | | |
|---|---|---|---|
| 1045847 | 10/1966 | United Kingdom | 222/79 |

*Primary Examiner*—Andres Kashnikow
*Assistant Examiner*—Karen B. Merritt
*Attorney, Agent, or Firm*—Kenneth P. Glynn

[57] ABSTRACT

Present invention is a water gun nozzle assembly for attachment to the barrel of a water gun having an egress path for shooting water through a nozzle. The nozzle assembly includes a nozzle head with an orifice for connection to an egress path of a toy water gun, a support for the nozzle head, a housing, and a handle. The housing is attachable to the barrel of a water gun with the support and nozzle head located within the housing and rotatably mounted therein, so as to sweep left to right and vice versa, with the support extending to the outside of the housing. The end of the support which extends outside of the housing is directly or indirectly connected to the handle. When the handle is indirectly connected it may be located elsewhere on the barrel or otherwise on the gun and rotatably connected indirectly to the support by a belt, gear, chain or other rotatable drive mechanism.

22 Claims, 3 Drawing Sheets

WATER GUN DIRECTIONAL NOZZLE

BACKGROUND OF THE INVENTION

1. Field Of The Invention

The present invention is directed to a water gun directional nozzle. More specifically, it involves a nozzle assembly which attaches to the barrel of the water gun. The nozzle head of the present invention nozzle assembly may be at least partially rotated about an axis which is approximately perpendicular to the central axis of the barrel, by rotation of a handle.

2. Prior Art Statement

Water guns historically rely upon direct pumping for shooting water or upon pressurization prior to shooting, whereby water exits through an egress path, such as rigid or flexible tubings and through a nozzle assembly. The nozzle assembly usually has a rigid cover-like housing and a fixed nozzle head or tip. The nozzle tip typically runs parallel with the central axis of the barrel. Thus, as the gun is aimed in a particular direction, the water shoots in that direction.

Some toy water guns have been developed with moveable nozzles. For example, Design U.S. Pat. No. 304,049 shows a toy water gun with an extensible nozzle.

U.S. Pat. No. 4,615,488 shows a toy water gun having three directional nozzles. They are based on rotational caps with a plurality of orifices.

U.S. Pat. No. 4,597,527 describes a toy water gun for shooting water in a plurality of directions. There is a cap which aligns with an orifice selected from a group of orifices to select a firing direction.

U.S. Pat. No. 2,888,172 describes a toy water gun with a multi-directional nozzle. A rotator operates in a ball and cup fashion. This prohibits 180 degrees sweeping and readily displays the firing direction to an observer.

U.S. Pat. No. 2,746,644 describes a toy water pistol with a discharge and with a turning movement about a vertical axis which involves the use of a flexible hose and a protrusion above the gun with a knob for turning side to side. This device involves the use of flexible hosing which will eventually wear and/or leak as the hosing itself bends with each twist of the discharge nozzle. Further, a user turning a knob reaches to do so and alerts others to a directional change in the firing of the water gun, whereas in the present invention, a user constantly holds the rotatable handle and the target is not so easily alerted.

None of the prior art permits a 180 degrees or greater horizontal sweep while firing with a recessed nozzle to avail the user of a trick or surprise shot to the side or in a reciprocal manner as with the present invention.

SUMMARY OF THE INVENTION

The present invention is a water gun nozzle assembly for attachment to the barrel of a water gun having an egress path for shooting water through a nozzle. The nozzle assembly includes a nozzle head with an orifice for connection to an egress path of a toy water gun, a support for the nozzle head, a housing, and a handle. The housing is attachable to the barrel of a water gun with the support and nozzle head located within said housing and rotatably mounted therein, so as to sweep left to right and vice versa, while the gun is held stationary or in motion, with the support extending to the outside of said housing. The end of the support which extends outside of said housing is directly or indirectly connected to the handle. When the handle is indirectly connected it may be located elsewhere on the barrel or otherwise on the gun and rotatably connected indirectly to the support by belt, gear, chain or other rotatable drive mechanism.

BRIEF SUMMARY OF THE DRAWINGS

The present invention described herein will be more fully appreciated when the specification is taken in conjunction with the drawings appended hereto, as follows.

DETAILED DESCRIPTION OF THE INVENTION

The present invention involves a unique nozzle assembly which enables the user to rotate a handle and thereby rotate a support connected to the barrel and a nozzle head within the support. This allows for a rotating of the nozzle head (at least partially) about an axis which is substantially perpendicular to the central axis of the toy water gun barrel.

The nozzle assembly of the present invention may be utilized with any toy water gun, although it is advantageously used with water guns which have prolonged shots of water, such as bladder reservoir water guns and pressurized tank water guns, e.g. the Super Soaker TM water gun line of Larami Corporation, Philadelphia, Pennsylvania.

The nozzle assembly of the present invention is generally intended to be assembled as part of a water gun during manufacturing of the gun itself, although it could be designed with fittings and a housing so as to retrofit an existing water gun by substitution for conventional, stationary nozzle heads and assemblies. It may be constructed of plastic or other material but is typically of the same general construction as conventional water gun nozzle assemblies.

The present invention nozzle head is connected to a support, e.g. attached to it or contained within it, and the support is held within a housing which is attached to a water gun barrel. The support acts like a shaft but contains a pathway for water from the egress path of the gun to the nozzle head. The support is held rotatably in place by the housing and the support (or its equivalent, i.e. an extension or attachment) extends to the outside of the housing and is attached to a handle. The support is set approximately perpendicular to the central axis of the barrel when the housing is attached to the barrel so that rotation of the handle effects a rotation of the support and nozzle tip in a sweeping fashion, i.e. left to right, and vice versa. The housing is designed to have an arcuated window in the path of the sweep of the nozzle tip to permit the user to shoot water across an arc without moving the gun itself. Thus, a user may surprise someone else by shooting in a direction different from the direction in which the water gun is pointed or may create a surprise "sweep", squirting several people without moving the gun.

Figure 1:
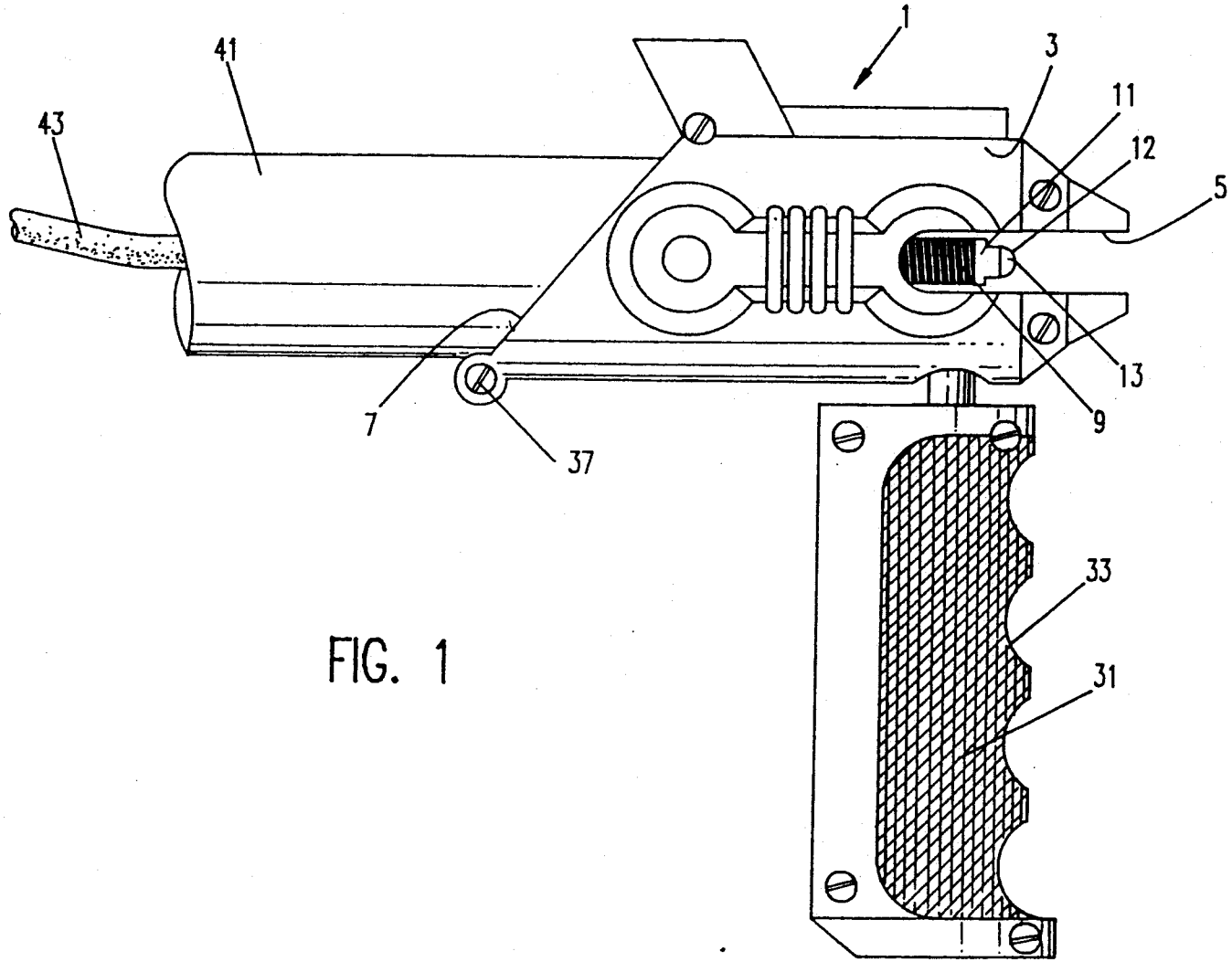
FIG. 1 shows a side view of a present invention water gun nozzle and partial side view of a water gun barrel to which it is attached.
Figure 2:
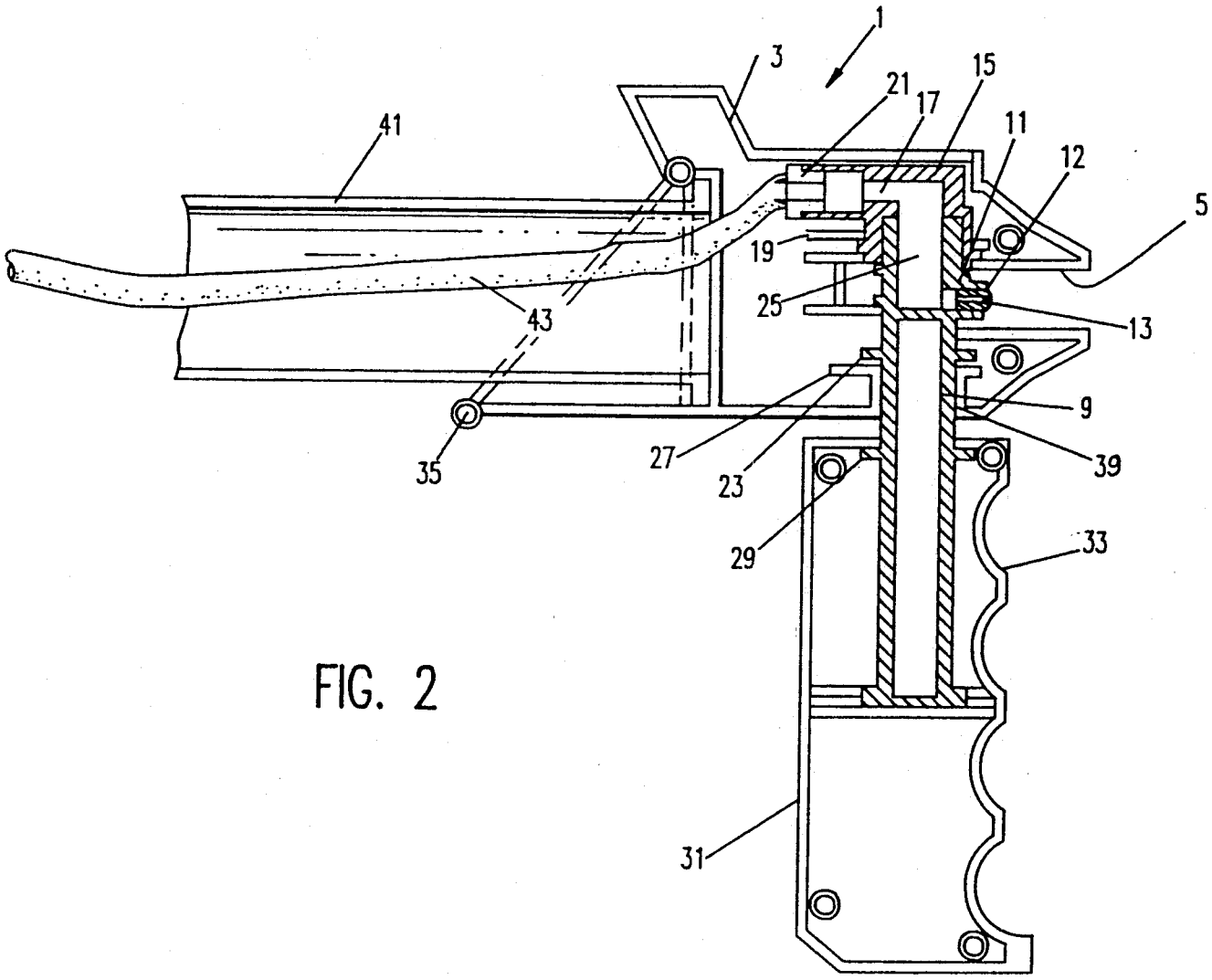
FIG. 2 shows a side cut view of the barrel and present invention nozzle assembly shown in FIG. 1; and, FIG. 3 shows a side view of an alternative present invention nozzle assembly and an exemplary type of water gun to which it is attached.

Referring now to both FIGS. 1 and 2, there is shown a present invention nozzle assembly 1 including housing 3, support 9, nozzle head 12 and handle 31. Housing 3 has a rear, barrel-receiving end 7 and a front cut out 5, which, in this embodiment is an arcuate window through which the water is shot from orifice 13 of nozzle head 12. This cut out could be other than arcuate as long as it does not inhibit shooting the water from the gun.

Housing 3 includes brackets such as brackets 19 and 27 adapted to hold connection means, e.g., connector 15, and rotatably hold support 9. Nozzle head 12 is held in place by nozzle head fitting 11 which is preferably a molded part of support 9. Orifice 13 of nozzle head 12 extends to support water path 25, as shown. Path 25 is connected to water path 17 of connector 15. This, in turn connects to coupler 21 which is connected to the water gun egress path, in this case, flexible tubing 43 extending through barrel 41 from water gun, water supply and other, conventional water gun components (not shown).

Support 9 extends out of housing 3 through opening 39 and into handle 31. Support flanges 23 and 27 maintains support 9 rotatably in place within housing 3, and flange 29 maintains support 9 fixedly attached to handle 31 so that as handle 31 is rotated, support 9 and nozzle head 12 are likewise rotated.

Optional finger grip indentations such as indentations 33 may be used or the handle may be shaped otherwise.

The nozzle assembly 1 may be attached to barrel 41 by any available means, e.g. molded thereto, screwed, snapped, clamped, glued or force fitted or otherwise. In this case, screw holes such as hole 35 are provided, as the housing 3 may be molded in two parts and screwed together with screws such as screw 37. The handle 31 could likewise be screwed together and flange 29 could be keyed or asymmetric to keep support 9 and handle 31 fixed relative to one another. Other conventional assembly techniques could be utilized without exceeding the scope of the present invention.

Figure 3:
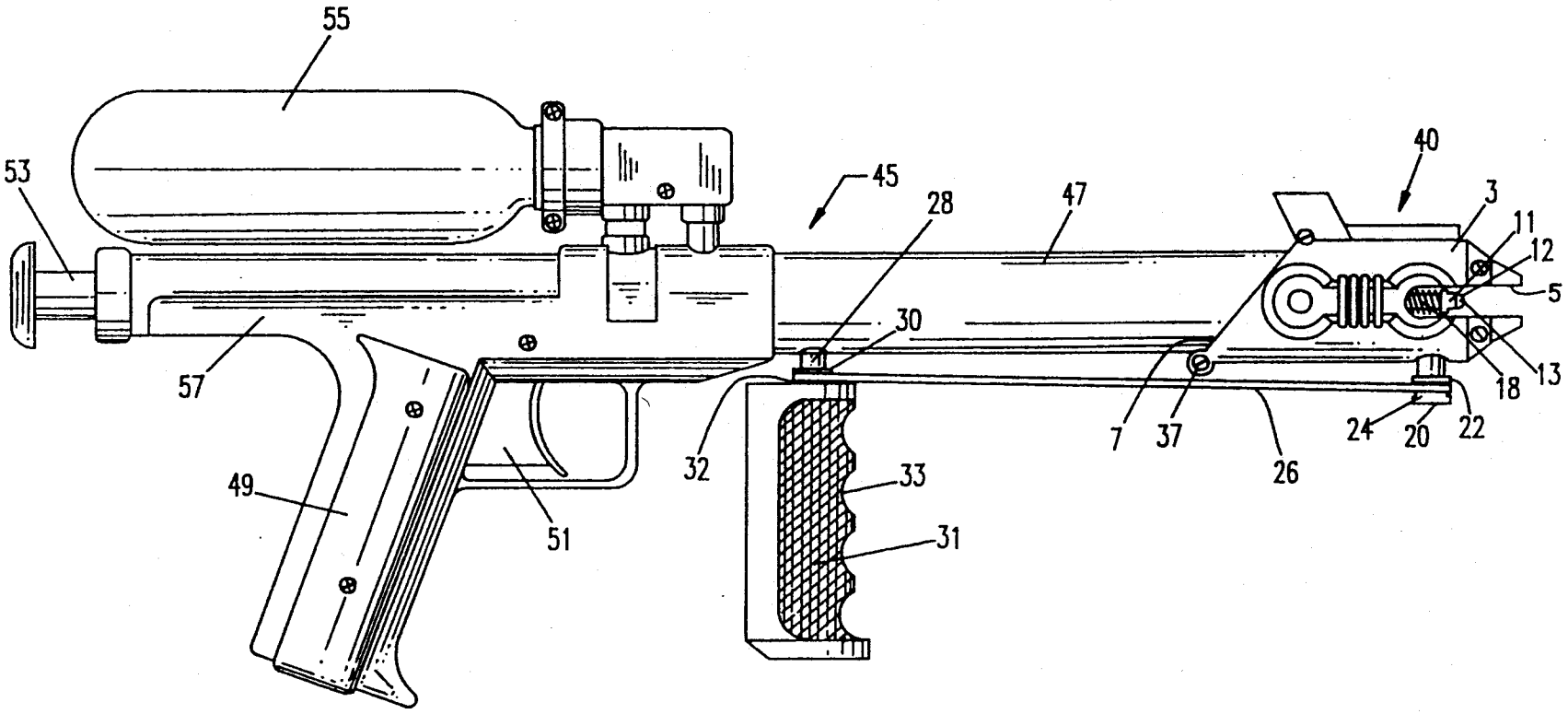

FIG. 3 shows a side view of an alternative embodiment present invention nozzle assembly 40, attached to water gun 45. Since many of the elements of the present invention nozzle assembly 40 in this Figure are the same as those in FIGS. 1 and 2, like parts are like numbered and need not be redescribed here. Water gun 45 includes, among other parts, main housing 57, handle 49, trigger 51, pump piston rod and handle 53 and water storage facility, e.g. tank 55. It is operated as a fill, pump and squirt water gun. On barrel 47 is located nozzle assembly 40 with the components as shown in FIGS. 1 and 2, except that handle 31 is remotely located from support 18. In this case, support 18 extends outwardly from housing 3 and is flanged or otherwise adapted to receive drive mechanism 26, e.g. a belt, rubber band, chain or the like. Closer to the center of water gun 45, on barrel 47, is rotatable shaft 28, with flanges 30 and 32 for holding drive mechanism 26. As handle 31 is rotated, nozzle head 12 is moved to the same extent.

If shaft 28 were of greater or lesser diameter than support 18 where drive mechanism 26 is attached, then a ratio of turning between the handle 31 and the support 18 with nozzle head 12 would be achieved. Alternatively, gears could be used separately or with other drive mechanisms, and a handle could be closer to the support and yet still be indirectly connected to the support.

Obviously, numerous modifications and variations of the present invention are possible in light of the above teachings. It is therefore understood that within the scope of the appended claims, the invention may be practiced otherwise than as specifically described herein.

What is claimed is:

1. In a toy water gun having an elongated barrel and an egress path for shooting water through a nozzle attached to said barrel, an improved nozzle assembly which comprises:

(a) a nozzle head having an orifice and adapted for connection to said egress path;

(b) a support for said nozzle head, said support being mounted within a housing for attachment to said barrel and having said nozzle head connected to said support, said nozzle head and support being rotatably mounted so as to rotate about an axis within said housing which is approximately perpendicular to a central axis of said barrel;

(c) a forward opening in said housing through which water may be shot, said housing containing said nozzle head and said support and being adapted for connection to said barrel, said support having an end which extends outside of said housing;

(d) connection means located within said housing for connection of said nozzle head to said egress path; and, (e) a handle connected to said support and positioned under said barrel, said handle adapted to rotate said support and being of sufficient size to accommodate the grasp of a human hand and aid in supporting said barrel of said toy water gun.

2. The nozzle assembly of claim 1 wherein said handle is directly connected to said support.

3. The nozzle assembly of claim 1 wherein said handle is indirectly connected to said support with a drive mechanism.

4. The nozzle assembly of claim 1 wherein said handle is provided with finger grip indentations.

5. The nozzle assembly of claim 1 wherein said forward opening of said housing is arcuate.

6. The nozzle assembly of claim 1 wherein said nozzle head is connected to said support at a location where a water path extends within said support from said nozzle head to said connection means.

7. The nozzle head of claim 6 wherein said handle is indirectly connected to said support with a drive mechanism.

8. The nozzle head of claim 6 wherein said handle is directly connected to said support and is positioned in such a way as to be rotated while the gun is being fired.

9. The nozzle head of claim 6 wherein said handle is indirectly connected to said support with a drive mechanism and is positioned in such a way as to be rotated while the gun is being fired.

10. The nozzle head of claim 6 wherein said forward opening of said housing is arcuate.

11. The nozzle head of claim 6 wherein said connection means is connected with a water path therein which extends from said support to said egress path.

12. The nozzle head of claim 1 wherein said connection means is connected with a water path therein which extends from said support to said egress path.

13. A toy water gun, which comprises:

(a) a main housing, water storage facility, water squirting means, an elongated barrel and a trigger;

(b) a nozzle assembly, which includes:

(i) a nozzle head having an orifice and adapted for connection to an egress path of said toy water gun;

(ii) a support for said nozzle head said support being mounted within a housing for attachment to said barrel and having said nozzle head connected to said support, said nozzle head and support being rotatably mounted so as to rotate about an axis within said housing which is substantially perpendicular to a central axis of said barrel;

(iii) a forward opening in said housing through which water may be shot, said housing containing said nozzle head and support and being adapted for connection to said barrel, said support having an end which extends outside of said housing;

(iv) connection means located within said housing for connection of said nozzle head to said egress path; and, (v) a handle connected to said support and positioned under said barrel, said handle adapted to rotate said support and being of sufficient size to accommodate the grasp of a human hand and aid in supporting said barrel of said toy water gun.

14. The toy water gun of claim 13, wherein said handle is directly connected to said support.

15. The toy water gun of claim 13, wherein said handle is indirectly connected to said support with a drive mechanism.

16. The toy water gun of claim 13, wherein said handle is equipped with finger grip indentations.

17. The toy water gun of claim 13, wherein said forward opening of said housing is arcuate.

18. The toy water gun of claim 13, wherein said nozzle head is connected to sad support at a location where a water path extends within said support from said nozzle head to said connection means.

19. The toy water gun of claim 18, wherein said handle is indirectly connected to said support with a drive mechanism.

20. The toy water gun of claim 18, wherein said forward opening of said housing is arcuate.

21. The toy water gun of claim 18, wherein said connection means is connected with a water path therein which extends from said support to said egress path.

22. The toy water gun of claim 13, wherein said connection means is connected to a water path therein which extends from said support to said egress path.

* * * * *